United States Patent [19]

Marforio

[11] 4,080,912

[45] Mar. 28, 1978

[54] WORKPIECE GUIDE FOR SEWING UNITS

[75] Inventor: Nerino Marforio, Milan, Italy

[73] Assignee: Rockwell-Rimoldi S.p.A., Milan, Italy

[21] Appl. No.: 775,605

[22] Filed: Mar. 8, 1977

[30] Foreign Application Priority Data

Mar. 11, 1976 Italy ..... 21070A/76

[51] Int. Cl.[2] ..... D05B 21/00

[52] U.S. Cl. ..... 112/121.15

[58] Field of Search ..... 112/121.12, 121.11, 112/121.15, 121.26, 152, 153, 203, 65

[56] References Cited

U.S. PATENT DOCUMENTS

| | | | |
|---|---|---|---|
| 3,463,101 | 8/1969 | Ansel | 112/121.15 |
| 3,618,545 | 11/1971 | Kosrow | 112/121.12 |
| 3,765,349 | 10/1973 | Gerber | 112/121.12 X |
| 3,810,436 | 5/1974 | Marforio | 112/121.15 |
| 4,013,025 | 3/1977 | Marforio | 112/121.15 |

*Primary Examiner*—H. Hampton Hunter

[57] ABSTRACT

A workpiece guide for a sewing unit for guiding pieces of fabric having accessories such as pockets, belts or the like to the stitching instrumentalities of a sewing machine. The guide is movable from a loading position to an operating position along the sewing axis by means of a gripping device carried by the guide which temporarily clamps the workpiece in an area devoid of accessories. In timed sequence with the work cycle, control devices automatically release the workpiece and return the guide to the loading position in readiness for the next work cycle.

9 Claims, 5 Drawing Figures

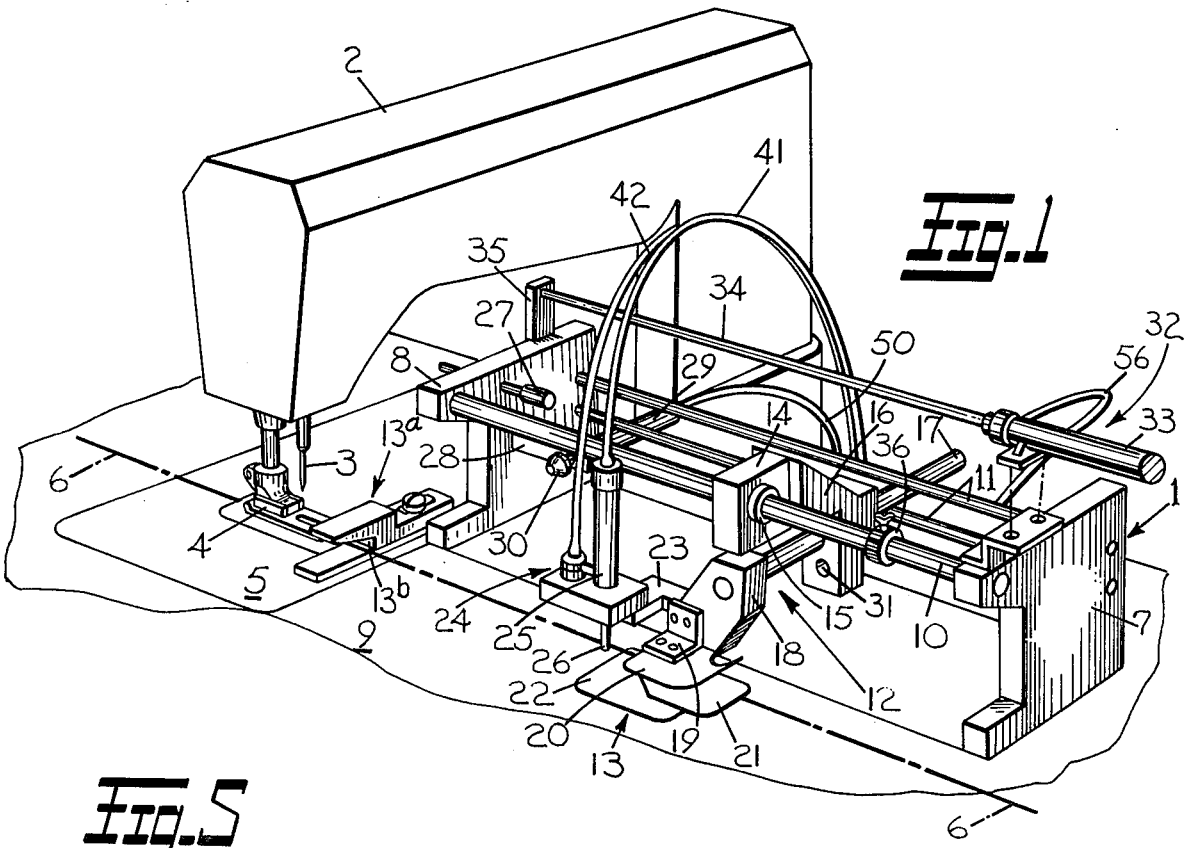
Fig. 1
Fig. 5
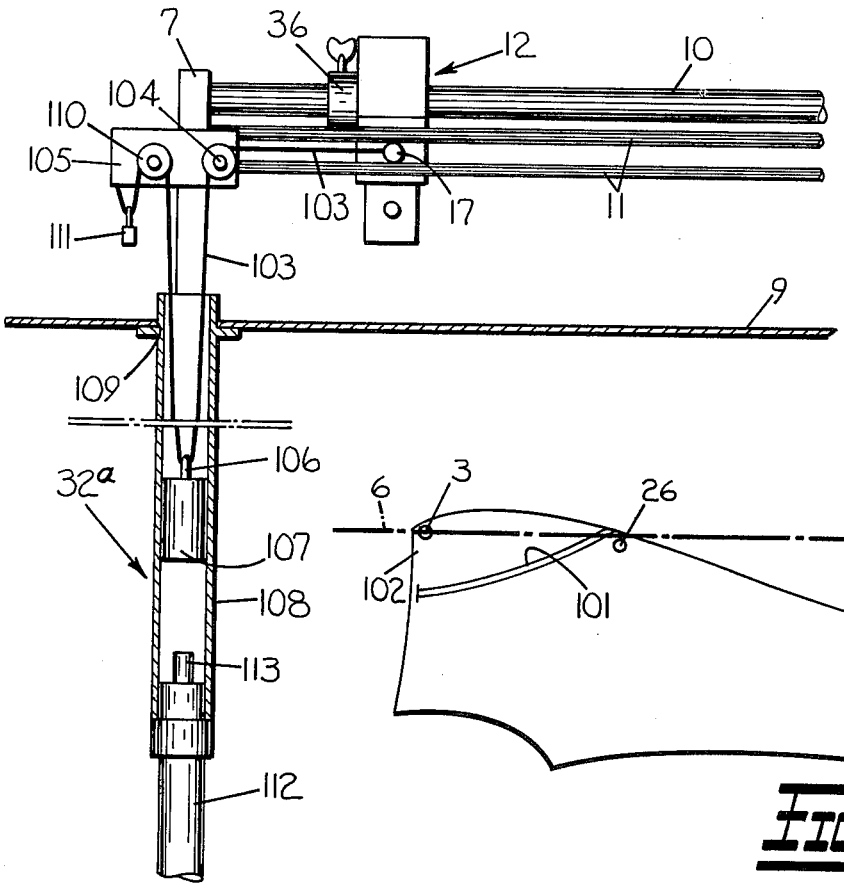
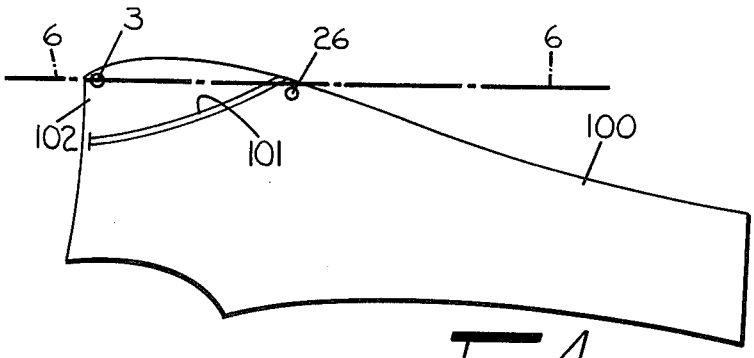
Fig. 4

WORKPIECE GUIDE FOR SEWING UNITS

BACKGROUND OF THE INVENTION

The present invention relates to a guide for pieces of fabric that include accessories such as pockets, belts, etc., in a sewing unit having a conventional sewing machine equipped with a needle and known types of feeding mechanisms which define a sewing axis along which the pieces of fabric are advanced in order to be assembled.

Conventional sewing machines are also provided with guides consisting of plates which are disposed one above the other and spaced apart from one another so as to form separate channels in which the pieces of fabric to be joined together are guided so as to enable them to slide separately during the sewing operation.

These guides, which are normally located in the vicinity of the sewing machine needle, are adapted to guide the pieces of fabric towards the needle in a manner to match their respective edges and to orient them with respect to the sewing axis according to the particular outer profile of the workpiece.

Consequently, the above mentioned means of joining together pieces of fabric is carried out in such a way that the pockets, which have already been attached, present an obstacle when the pieces of fabric are being advanced between the plates which form the guide. It is therefore necessary to carry out two preliminary operations: the first is that of temporarily removing the guide from the zone of passage of the pieces of fabric when the part containing a pocket is being sewn.

It is necessary to remove the guide in this manner to prevent the intermediate plate of the guide, which separates the pieces of fabric, from being inserted in one of the pockets, which, as is known, are disposed between said pieces of fabric, and which would prevent the pieces of fabric from sliding freely in the guide.

The second preliminary operation is that of manually guiding the pieces of fabric when stitching those portions provided with pockets so as to maintain the pieces of fabric correctly oriented and matched when the guide has been removed.

These preliminary operations are responsible for what is considered a considerable loss of time relative to the total sewing time which prevents the operator from performing other preparatory operations on other pieces of fabric to be assembled or from loading other sewing units.

The returning of the guide to the zone of passage of the pieces of fabric is normally accomplished by a pneumatic control means and necessitates special attention by the operator to assure that the pieces of fabric are correctly inserted in their respective guide channels.

The object of the present invention is to eliminate the aforementioned preliminary operations and also eliminate the delayed insertion of the pieces of fabric in the guide when the work cycle is already in progress.

The technical problem to be solved in order to achieve this object is that of inserting the pieces of fabric to be assembled in the guide before commencing the work cycle by placing the guide per se in a position in which it will not interfere with accessories which were previously attached to the pieces of fabric.

SUMMARY OF THE INVENTION

This technical problem is solved by means of a guide of the aforementioned type provided with the following features:

a. a guide equipped with plates which are disposed one above the other and spaced apart from one another so as to form two channels in which the separate pieces of fabric are caused to slide separately;
b. a support means for the guide which is movable parallel to the sewing axis;
c. a gripping and holding means for clamping the pieces of fabric temporarily in the guide while they are being advanced to the stitching instrumentalities;
d. a control device for the gripping means;
e. first control means for the control device acting on the latter at the beginning of the work cycle so as to activate the gripping means; and
f. second control means operatively associated with the first control means for the gripping means upon termination of sewing the part of the pieces of fabric comprising the accessories; the guide being caused to move from a loading position to an operating position directly by the pieces of fabric through the intermediary of the gripping means.

Other features and advantages of the present invention will be made apparent in the following detailed description thereof which is provided with reference to the accompanying drawings, in which:

BRIEF DESCRIPTION OF THE DRAWINGS

FIG. 1 is a perspective view of a sewing unit equipped with the guide according to the present invention;

FIG. 4 is a diagrammatic view of a workpiece sample to be assembled; and

FIG. 5 is a rear view of a feature of a modification of the guide.

DESCRIPTION OF THE PREFERRED EMBODIMENT

Figure 3:
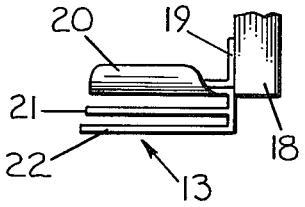
FIG. 3 is a cross-section of the guide.

Referring now to FIG. 1, the guide 1 according to the invention is associated with a sewing unit comprising a conventional sewing machine 2 having a needle 3 and a presser foot 4 pressing in a conventional manner on a throat plate 5 from which the conventional feeding mechanisms (not shown) project periodically.

The feeding mechanisms together with the needle define a sewing axis 6 along which the workpiece consisting of two pieces of fabric to be joined is advanced.

The workpiece may consist, for example, of pant sections 100, at least one of which is provided with a pocket 101 (FIG. 4).

The guide 1 is disposed forwardly of the sewing machine 2. The guide 1 consists essentially of two vertical supports 7 and 8 which are supported on the work bed plate 9 of the sewing unit and which are spaced apart from one another. Horizontally disposed between the vertical supports 7 and 8 is a slide bar 10 and two retaining bars 11 which are arranged one above the other and in a retracted position with respect to the slide bar 10.

A support means or carriage member 12 for a fabric guide 13 is mounted on the slide bar 10.

The support means consist essentially of a movable support block 14 having a suitable slide bushing 15 through which the aforementioned slide bar 10 extends.

As shown in FIG. 1 one side of the movable block 14 has a support arm 16 fixed thereto by any suitable means not shown and adjustably supports a horizontally disposed shaft 17 therein.

This adjustment feature is provided to enable the guide 13 to be correctly positioned with respect to the sewing axis 6.

More specifically, the positioning of the guide 13 serves to adjust the distance between the stitching to be formed and the edge of the fabric that is guided within the guide.

One end of the horizontal shaft 17 extends between and in a plane normal to the axis of the retaining bars 11 which are spaced apart from one another by an amount corresponding to the thickness of said horizontal shaft so as to permit longitudinal movement thereof without pivoting about the slide bar 10.

A depending support 18 is attached to the opposite end of the horizontal shaft 17 and serves to support the fabric guide 13 by means of an "L" shaped bracket 19.

As shown more clearly in FIG. 3, the fabric guide 13 includes an upper plate 20, an intermediate plate 21 and a lower plate 22 which are disposed one above the other and in spaced relation which defines two channels within which the separate pieces of the fabric workpiece are caused to slide so as to be matched and oriented with the sewing axis 6.

The depending support 18 is provided with a bracket member 23 which serves to support a gripping and holding means identified generally in FIG. 1 by numeral 24. The gripping means 24 includes a vertically disposed pneumatic cylinder 25 whose piston rod 26 overhangs the lower plate 22 of the fabric guide 13 and with which it makes contact to temporarily block both of the aforementioned pieces of fabric while the gripping means 24 is actuated in a manner that will be more fully described hereinafter in the paragraph entitled "Mode of Operation".

An end-of-stroke actuator 27 in mounted adjacent one end of the slide bar 10 so as to cooperate with the support means 12 of the guide at the end of its travel which the latter performs while guiding the pieces of fabric to be assembled.

The end-of-stroke actuator, which defines the operating position of the fabric guide 13, is adjustably mounted in the support 8 to which a support plate 28 is also attached. Blocking means consisting of a pneumatic cylinder 29 is mounted on the support plate 28. The piston rod of the cylinder 29 is provided with an end 30 which is designed to be inserted in a corresponding hole 31 provided in the support arm 16 of the support means 12.

Lastly, the guide 1 is equipped with pneumatic return means 32 for the guide 13 and includes a pneumatic cylinder 33 whose piston rod 34 carries a depending lug 35 on its free end that is adapted to make contact with the block 14 of the support means 12 in order to move the latter from its operating position adjacent to the sewing machine 2 to a loading position for the separate pieces of the fabric workpiece.

The loading position is spaced from the sewing machine and is defined by an adjustable collar 36 assembled as shown in FIG. 1 on the slide bar 10.

Figure 2:
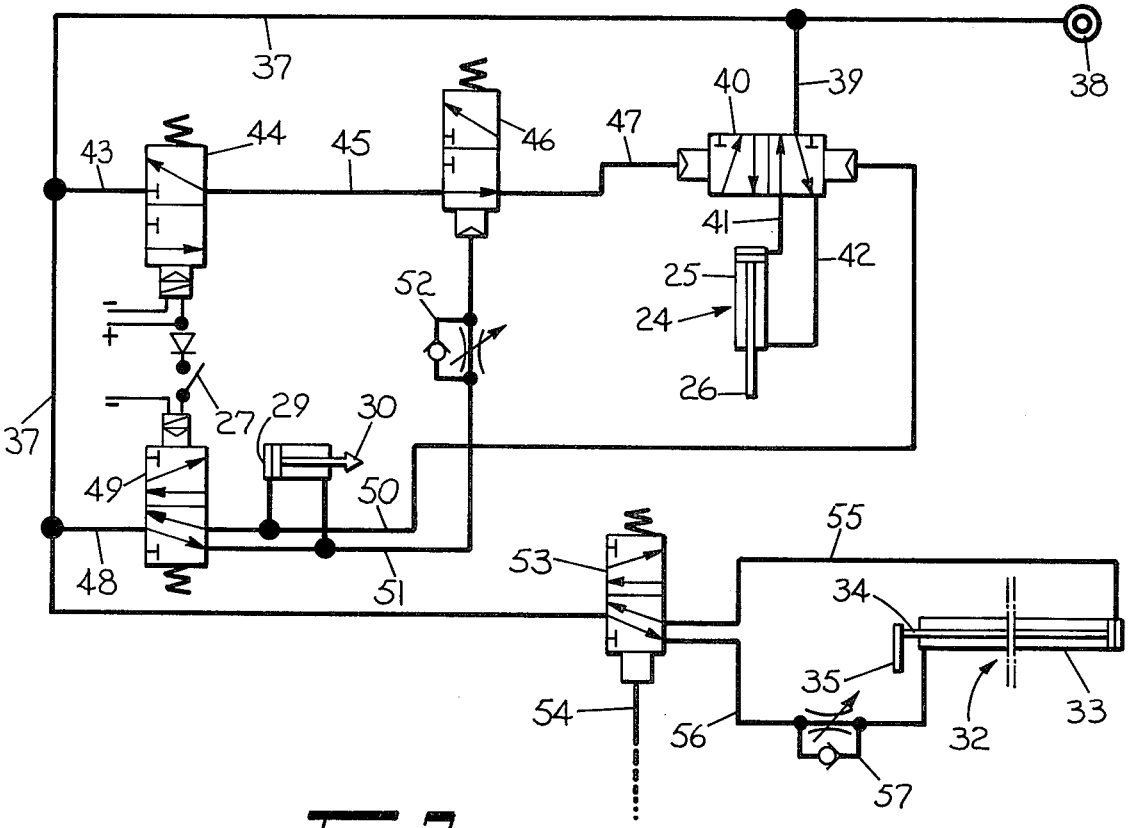
FIG. 2 shows a pneumatic control circuit for the device shown in FIG. 1.

Referring now to FIG. 2, the pneumatic control circuit for the guide 1 is provided with a main conduit 37 that is connected to a conventional compressed air source 38 and from which leads a conduit 39 connected to a control device consisting of a distributor box 40 connected by means of the conduits 41 and 42 to the gripping means 24.

A first control means for the control device is supplied from the main conduit 37 by means of a conduit 43. This control device includes a first electrovalve 44 connected by a conduit 45 to a pressure valve 46 which is connected by means of a conduit 47 to the pilot mechanism of the distributor box 40.

The main conduit 37 also supplies a second control means for the control device by means of a conduit 48.

The second control means has a second electrovalve 49 acting on the pilot mechanism of the aforementioned distributor box 40 by means of a conduit 50 from the opposite side to that of the first electrovalve 44.

The first electrovalve 44 is activated by an electric pulse corresponding to the starting of the sewing unit while the second electrovalve 49 is activated by the end-of-stroke actuator 27 on which the support means 12 of the guide 13 act at the end of the movement which the latter performs while guiding the pieces of fabric to be assembled.

The second electrovalve 49 acts on the pilot mechanism of the pressure valve 46 of the first control means by way of another conduit 51 via a common stroke regulator 52.

The conduits 50 and 51 are also used to supply the pneumatic cylinder 29 of the blocking means such that when the second electrovalve 49 is activated the support means 12 is blocked, and also the guide 13 in its operating position.

Lastly, the main conduit 37 supplies compressed air to the return means 32 which includes a valve 53 whose pilot mechanism is controlled by means of a conduit 54 directly by a conventional pneumatic device (not shown) for raising the presser foot of the sewing machine.

The valve 53 is connected by means of conduits 55 and 56 to the pneumatic cylinder 33 of the return means 32.

A stroke regulator 57 is provided on the conduit 56.

MODE OF OPERATION

Before starting the work cycle the presser foot 4 is first raised by the operator so that the leading edges 102 of the pieces of fabric 100 to be assembled can be inserted.

When the presser foot is raised, a pneumatic pulse acts on the pilot mechanism of the valve 53 putting it into the position shown in FIG. 2 which corresponds to the supplying of the conduit 56.

As a result, the depending lug 35 is moved in a direction to engage the block 14 and is effective in moving the latter and the support means 12 to the loading position of the guide.

The space between the loading position and the needle 3 of the sewing machine is such as to include those portions of the pieces of fabric provided with the pockets 101 and thus prevents interference between the latter and the intermediate plate 21 of the guide 13.

Immediately after termination of the preliminary step of inserting the aforementioned leading edges 102 beneath the presser foot the operator inserts the separate pieces of fabric into their respective channels of the guide 13 and then actuates the means for lowering the presser foot.

Following the lowering of the presser foot, the conduit 54 ceases to be supplied and the valve 53 switches the air supply from the conduit 56 to the conduit 55, causing the depending lug 35 to be moved away from the movable block 14 toward the sewing machine and thus allowing the support means of the guide to be displaced without any impediment or obstruction.

The sewing machine is now started and an electric pulse reaches the first electrovalve 44, causing it to open and thus acting on the pilot mechanism of the distributor box 40.

As a result, switching occurs from the conduit 39 to the conduit 41 which produces the lowering of the rod 26 of the gripping means on the underlying pieces of fabric such that the latter are held against the lower plate 22 of the guide 13. The guide is therefore drawn towards the sewing machine 2 and during this movement it keeps the pieces of fabric aligned according to the sewing axis 6.

More specifically, stitching is also executed parallel to the profile of the edge in the part occupied by the pockets owing to the fact that an auxiliary guide 13*a* is provided in a fixed position adjacent the presser foot 4.

This auxiliary and conventional type guide is effective in moving the aforementioned portions of the fabric at right angles to the sewing axis 6 by means of its respective vertical wall 13*b*.

Thus, although the pieces 100 have a curvilinear edge in the portions occupied by the pockets, as shown in FIG. 4, the wall 13*b* is effective in maintaining the edge in perfect alignment with the sewing axis 6.

The movement of the guide 13 stops when the movable block 14 comes into contact with the end-of-stroke actuator 27.

The end-of-stroke actuator 27 closes the electric feed circuit of the second electrovalve 49 which leads from that of the first electrovalve 44 — as a result of which it is possible to obtain excitation of the second electrovalve if the first electrovalve 44 is excited.

Excitation of the second electrovalve 49 causes switching from the conduit 48 to the conduit 50 resulting in the admission of compressed air into the cylinder 29 of the blocking means causing the end 30 to enter the hole 31 in the support means 12 so as to lock it in that position corresponding to the operating position of the guide 13.

The supplying of the conduit 50 simultaneously causes the activation of the distribution box 40 which switches the conduit 39 to the conduit 42, moving the rod 26 upwardly and out of engagement with the pieces of fabric.

Switching of the distributor box 40 is possible due to the fact that the flow of compressed air in the conduit 52 has ceased and as a result the valve 46 interrupts the admission of compressed air to the pilot mechanism of the distributor box 40.

The pieces of fabric to be assembled are now free to continue their movement towards the sewing machine, sliding in the guide which remains closed. Although the guide is first adapted to serve as a clamp together with the gripping means 24, it completes its function in cooperation with the auxiliary guide 13*a*, to match and orient the edges of the fabric according to the sewing axis 6.

As soon as the work cycle is terminated the sewing machine stops, causing a cessation of excitation of the first electrovalve 44 which interrupts the flow of compressed air to the valve 46. The second electrovalve 49 also ceases to be excited, causing the restoring of the pneumatic connection with the conduit 51 which terminates the disengagement of the end 30 from the hole 31 and the pre-arrangement of the valve 46 for the connection of the conduit 45 with the conduit 47.

As the presser foot 4 is automatically raised at the end of the work cycle, the valve is also activated by the feed through the conduit 54.

The compressed air flow thus passes from the conduit 55 to the conduit 56 causing activation of the return means 32 and longitudinal movement of the piston rod 34 of the cylinder 33 which is effective in returning the guide 13 to its loading position and in readiness for the next work cycle.

According to a possible modification of the return means 32 (FIG. 5), the support means 12 is connected to a cable 103 which is operatively connected to a first pulley 104 rotatably mounted on a plate 105 that is attached to the support 7.

Cable 103 extends through an eye 106 provided in a counter-weight 107 which is slidable carried within a cylindrical member 108. This cylinder member is assembled in an opening 109 in the work bed plate 9 and depends from the latter in a conventional manner.

The cable engages a second pulley 110 and adjacent to the latter is provided with another counter-weight 111 which exerts a slight pull on said cable so as to prevent any twisting thereof.

One end of the cable 103 is attached to the plate 105. The cylindrical member 108 is closed at its lower end by means of a pneumatic cylinder 112 which performs the same function as the pneumatic cylinder 33.

During the movement of the support means 12 of the guide 13 the pneumatic cylinder 112 is actuated so that its respective piston rod 113 is fully extended and is effective in maintaining the counter-weight 107 in its uppermost position within the cylindrical member and 108 corresponds to the total displacement of the support means for the guide. With the counter-weight in this position there is no pull on the pieces of fabric during the entire stage of sewing those portions of the workpiece which include pockets.

The tensioning counter-weight 111 acts on the cable 103 only in this state in opposition to the drag exerted by the pieces of fabric, but without negatively influencing the stitching produced in the latter.

As soon as the work cycle has been terminated the reversal of the feed to the cylinder 112 causes the reentry of the piston rod 113 and thus the lowering of the counter-weight 107 which returns the support means 12 to the loading position against the adjustment ring 36.

The use of the guide according to the present invention eliminates any preliminary operations other than that employed to insert the pieces of fabric to be assembled beneath the presser foot of the sewing machine and in the guide per se prior to commencing the work cycle, and necessitates no further intervention on the part of the operator.

In the above description specific reference has been made to the use of the device according to the invention for assembling parts of pants, at least one of which is provided with a pocket. However, it is obvious that the use of the device can be extended to assembly operations involving pieces of fabric which do not include accessories but wherein it is important for accompaniment to be provided for a specific initial section.

The type of guide can also differ from the one described. For example, it is possible to provide a single channel in which one or more pieces of fabric can slide without departing from the scope of the present invention.

I claim:

1. A workpiece guide for a sewing unit of the type including a work bed plate with a sewing machine operatively associated therewith having a needle and feeding mechanisms defining a sewing axis along which pieces of fabric having accessories such as pockets, belts and the like are advanced to the stitching instrumentalities, said workpiece guide comprising:

(a) a carriage member (12) mounted on the work bed plate for sliding movement parallel with the sewing axis:

(b) a fabric guide (13) attached to said carriage member (12) and movable therewith between loading and operating positions, said fabric guide having plate members (20, 21, 22) disposed one above the other to define channels for separately guiding the individual pieces of fabric forming the workpiece;

(c) means supported by said carriage member (12) for gripping and holding the pieces of fabric within their respective channels during advance of the workpiece to the stitching instrumentalities;

(d) a control device (40) operatively connected to and for actuating said gripping and holding means;

(e) a first control means (44, 46) connected to said control device for activating the latter at the beginning of the work cycle to effect actuation of said gripping and holding means; and (f) a second control means (27, 49) operatively connected to said control device for deactivating said gripping and holding means upon arrival of said fabric guide (13) at said operating position.

2. The workpiece guide according to claim 1 wherein said guide includes a blocking means (29, 30) operatively associated with said second control means (27, 49) and said carriage member (12) on arrival at said operating position for effecting simultaneous blocking of said fabric guide (13) and release of the workpiece through deactivation of said gripping and holding means.

3. The workpiece guide according to claim 1 wherein said guide includes a pneumatic return means having a control means (53, 54) operatively connected with said carriage member 12 when said fabric guide (13) is in said operating position for effecting movement of said fabric guide (13) to said loading position.

4. The workpiece guide according to claim 3 wherein said return means includes a pneumatic cylinder (33) having a piston rod (34) with a depending lug (35) fixed on said rod for engaging said carriage member 12 and effect movement thereof with said fabric guide (13) from operating to loading position in timed sequence with the work cycle.

5. The workpiece guide according to claim 3 wherein said return means includes:

(a) a cylindrical member (100) fixed to and depending from the work bed plate;

(b) a counter-weight (107) interconnected by means of a cable (103) with said carriage member (12) and suspended for vertical movement within said cylindrical member (108); and (c) a pneumatic cylinder (112) fixed to one end of said cylindrical member (108) having a piston rod (113) operatively associated with said counter-weight (107) for maintaining the latter in an elevated position while said carriage is in operating position and for releasing the same to effect movement of said carriage member to the loading position by said cable (103).

6. The workpiece guide according to claim 1 wherein said carriage (12) includes a movable block (14) mounted for sliding movement on a slide bar (10) and a horizontal shaft (17) extending in a plane normal to the axis of said slide bar having a depending support (18) fixed on one end thereof for supporting said fabric guide (13) and with the opposite end extending between a pair of retainng bars (11) for preventing pivotal movement of said carriage (12) on said slide bar 10 during movement thereof between the loading and operating positions.

7. The workpiece guide according to claim 6 wherein said movable block (14) includes a support arm (16) fixed thereto for supporting said horizontal shaft (17) for selective sliding movement therein whereby said fabric guide (13) is laterally adjustable relative to the sewing axis.

8. The workpiece guide according to claim 7 wherein the loading position of said carriage (12) is defined by an adjustable collar (36) selectively positionable on said slide bar (10) and the operating position thereof is defined by an end-of-stroke actuator (27) adjustably mounted for engagement by said movable block (14) adjacent one end of said slide bar 10.

9. The workpiece guide according to claim 1 wherein said gripping and holding means (24) includes a vertically disposed pneumatic cylinder (25) supported on a bracket member (23) to and for movement with said carriage (12), said pneumatic cylinder (25) having a piston rod (26) movable in timed sequence with the work cycle to and from a position of operative association with said fabric guide (13).

* * * * *